United States Patent [19]

Anderson et al.

[11] Patent Number: 4,461,135

[45] Date of Patent: Jul. 24, 1984

[54] WALLBOARD TRIM APPARATUS

[75] Inventors: Dallas A. Anderson, 541 Manor Dr. NE., Spring Lake Park, Minn. 55432; Harlan J. Grayden, 2764 Churchill St., Roseville, Minn. 55113

[73] Assignees: Michael W. Ognanovich; Dallas A. Anderson; Milfred A. Langseth; Harlan J. Grayden, all of New Brighton, Minn.

[21] Appl. No.: 317,451

[22] Filed: Nov. 2, 1981

[51] Int. Cl.[3] ..... E04C 2/38; E06B 1/04

[52] U.S. Cl. ..... 52/827; 52/211; 52/287; 52/466; 52/718

[58] Field of Search ..... 52/211, 242, 290, 287, 52/463, 466, 718, 717, 827

[56] References Cited

U.S. PATENT DOCUMENTS

| | | | |
|---|---|---|---|
| 1,308,276 | 7/1919 | Connell | 52/212 |
| 2,148,847 | 2/1939 | Wiley | 52/718 |
| 2,184,255 | 12/1939 | Kral | 52/718 X |
| 2,216,219 | 10/1940 | Wiley | 52/718 X |
| 2,604,776 | 7/1952 | Goldsmith | 52/242 |
| 2,676,483 | 4/1954 | Nelsson | 52/242 |
| 2,887,870 | 5/1959 | Slowinski | 72/46 |
| 2,903,753 | 9/1959 | Nelson | 20/4 |
| 2,942,703 | 6/1960 | Nelsson | 189/88 |
| 3,027,605 | 4/1962 | Nelsson | 20/4 |
| 3,046,616 | 7/1962 | Sampsell | 20/11 |
| 3,255,561 | 6/1966 | Cable | 52/255 |
| 3,788,019 | 1/1974 | Kiselewski | 52/212 |
| 3,998,027 | 12/1976 | Wendt | 52/716 |
| 4,014,146 | 3/1977 | Dimascio et al. | 52/211 |
| 4,094,112 | 6/1978 | Smith et al. | 52/211 |

FOREIGN PATENT DOCUMENTS

| | | | |
|---|---|---|---|
| 1206755 | 9/1970 | United Kingdom | 52/718 |

*Primary Examiner*—Alfred C. Perham

*Attorney, Agent, or Firm*—Schroeder, Siegfried, Vidas & Arrett

[57] ABSTRACT

An apparatus for supporting an edge-finishing strip along an edge of a partition-forming sheet of wallboard. A plurality of clips grip the wallboard along the edge in spaced relation to each other, the clips being supported on the wallboard without fasteners. An elongated finishing strip has a trim member for obscuring the edge and a flange insertable between the clips and the wallboards for supporting the trim member in obscuring relation to the edge. The clips may be provided with additional portions engageable with the finishing strip to enhance the support of the trim along the edge.

3 Claims, 9 Drawing Figures

Fig. 1
PRIOR ART
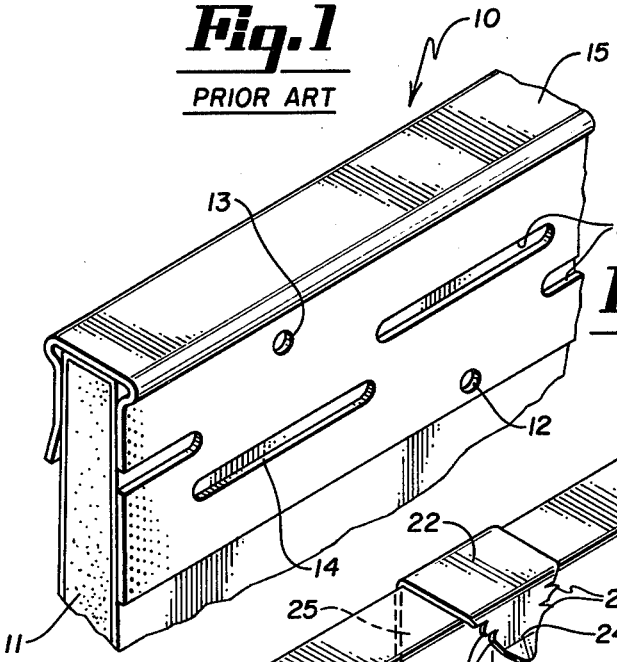
Fig. 2
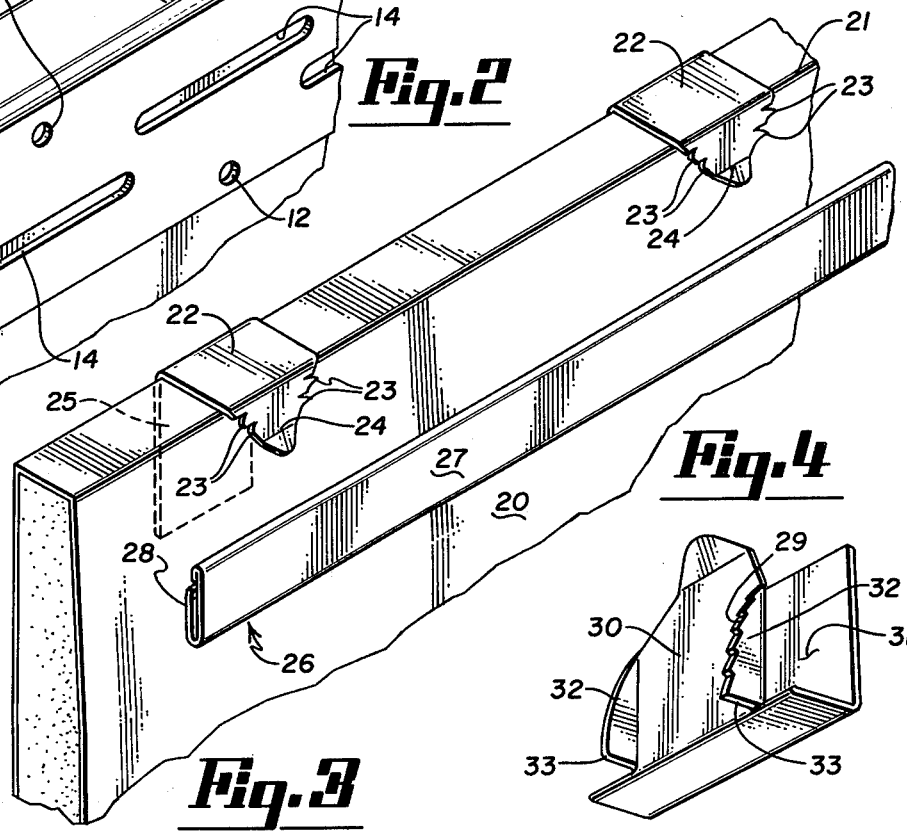
Fig. 4
Fig. 3
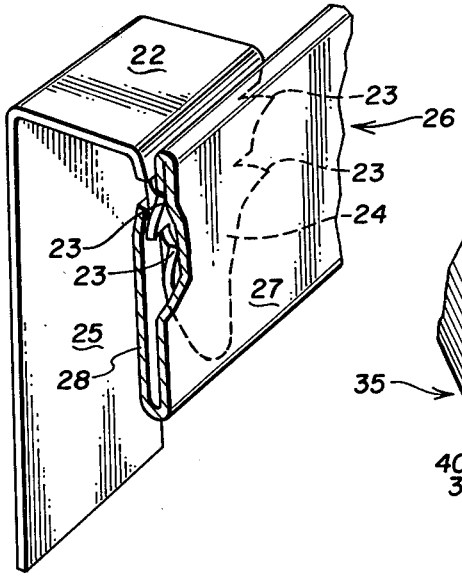
Fig. 5
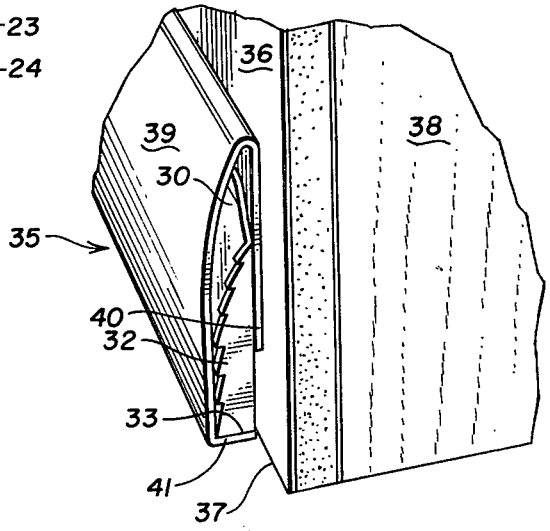

Fig. 6
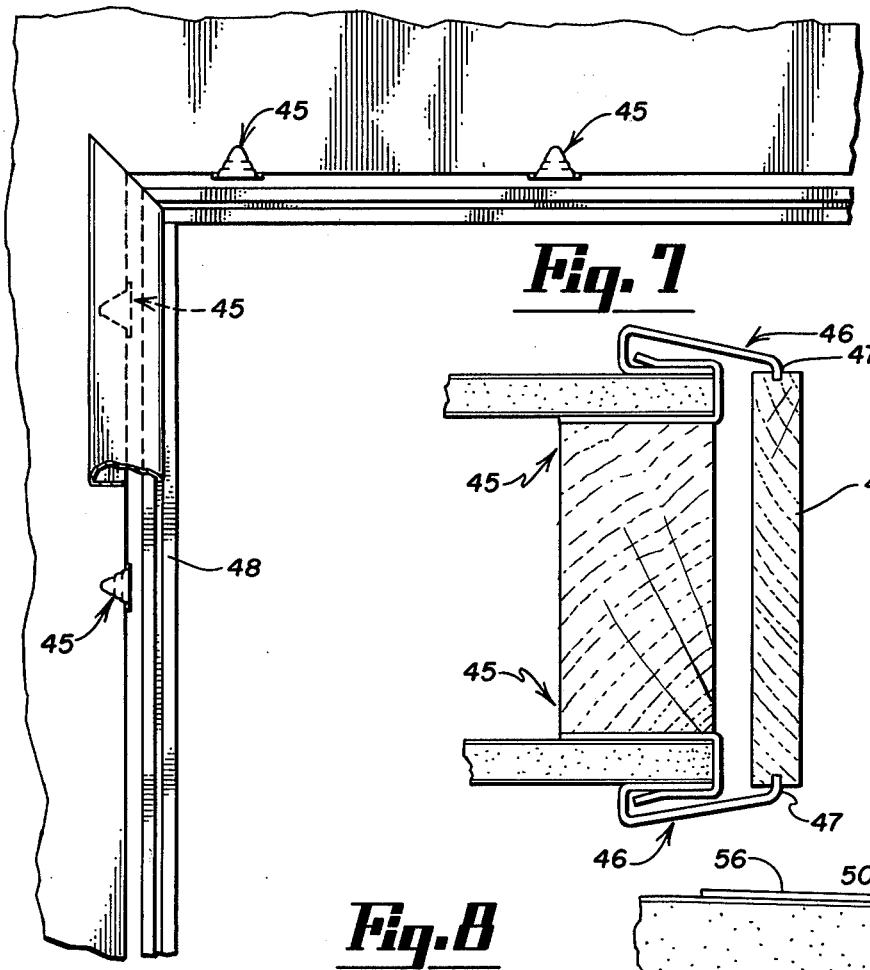
Fig. 7
Fig. 9
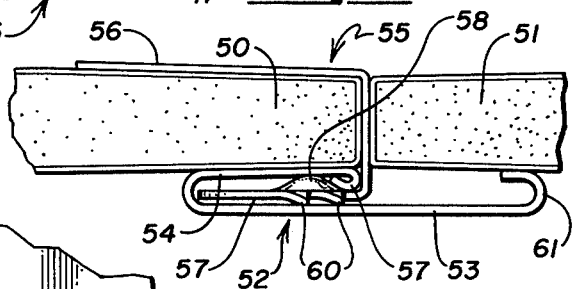
Fig. 8
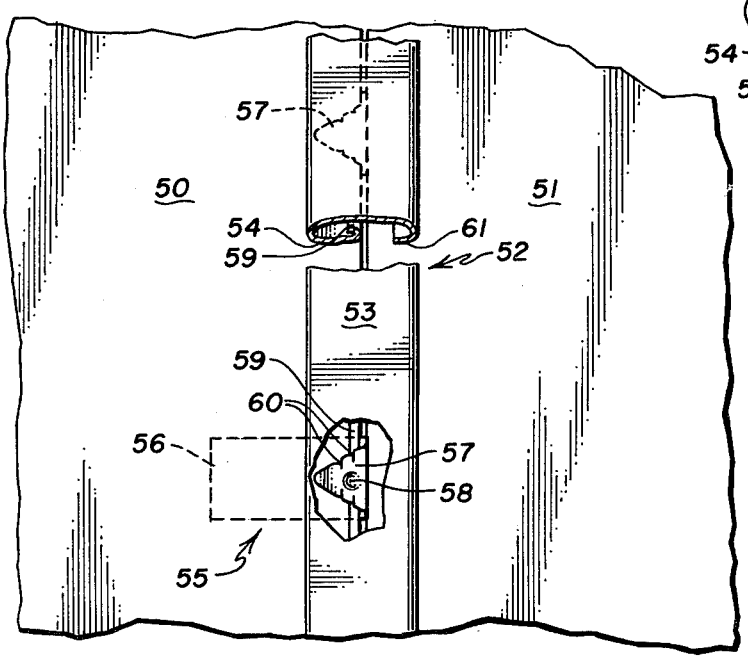

WALLBOARD TRIM APPARATUS

DESCRIPTION

Background of Prior Art

Edge-finishing of wallboard construction is known to the prior art. In recent years, alternatives to wood trim have been used, wood trim being costly to manufacture and install while requiring extensive care and frequent refinishing. Typically, these alternatives have employed metal or plastic trim pieces secured in place through the use of anchoring devices. In most instances, the anchoring devices are maintained in position through the use of fasteners. In some instances, the trim piece, itself, is secured by fastening devices.

An example of the latter is illustrated in U.S. Pat. No. 3,255,561 issued Aug. 6, 1956, to G. C. Cable for WALLBOARD TRIM CONSTRUCTION. The invention of FIGS. 3 and 4 of the referenced patent is illustrated in FIG. 1 hereof as prior art. In FIG. 1, a U-shaped trim member 10 is positioned over an edge of a wallboard sheet 11 which is to be finished. The trim piece 10 is anchored to the wallboard 11 by nails engaging the wallboard 11 through nail holes 12 (one shown) while other apertures, 13 and 14 accept a filler material of taping compound which is applied over the trim member to finish the installation. The surface 15 is a finished surface and does not require application of a filler material.

While the construction disclosed in the referenced patent has advantages over wood-trim construction, it nonetheless requires the use of fasteners and the application of a filler material to complete the installation. Other systems have been devised which eliminate the use of filler material. However, to our knowledge, these systems all require the use of fasteners, either to secure the anchoring system to the wallboard or to a floor or ceiling, for example.

BRIEF SUMMARY OF INVENTION

The present invention provides a method and apparatus for supporting an edge-finishing strip along an edge of a partition-forming sheet of wallboard, without the use of fasteners. For the purpose of this specification and claims, the term "fasteners" is intended to embrace material penetrating fastening devices such as nails, screws, etc. The present invention may be employed along any edge to be finished including applications as ceiling and base moldings, around a door opening, and at abutments between adjacent sheets of wallboard. It is contemplated that the present invention will be applied to finish the edge of a sheet of wallboard that forms a part of a wall, or other partition.

In a preferred embodiment of the present invention, a plurality of generally U-shaped clips grip the wallboard along the edge to be finished in spaced relation to each other. The clips are supported on the wallboard without fasteners. An elongated finishing strip has a trim portion which overlies the clips to obscure the edge and a flange portion insertable between the clips and the wallboard, the flange supporting the trim such that the edge is obscured. Typically, the flange and trim portions will be generally co-extensive in length with, and in opposing relation to each other. The clips may be formed with portions engageable with a portion of the finishing strip to enhance the support of the trim by the clip. The engageable portion may comprise teeth engaging a surface of the trim or a shoulder engaging a shoulder of the finishing strip. Dimples and cooperating rims as well as other securement enhancing systems may also be employed.

BRIEF DESCRIPTION OF DRAWINGS

FIG. 1 illustrates a prior art system for finishing a wallboard edge.

FIG. 2 is an exploded view illustrating a preferred embodiment of the present invention.

FIG. 3 illustrates the embodiment of FIG. 2 in assembled relation.

FIG. 4 illustrates an alternative embodiment of a portion of the present invention.

FIG. 5 illustrates the application of the embodiment of FIG. 4.

FIG. 6 illustrates an alternative application and embodiment of the present invention.

FIG. 7 illustrates a top view of the embodiment of FIG. 6.

FIG. 8 illustrates an alternative application and embodiment of the present invention.

FIG. 9 illustrates a top view of the embodiment of FIG. 8.

DETAILED DESCRIPTION OF INVENTION

Referring now to FIG. 2, there is illustrated a sheet of wallboard 20 having an edge 21 that it is desired to finish. Edge 21 may lie along a ceiling, for example. A plurality of clips 22 grip the wallboard 20 in spaced relation to each other along the edge 21. The clips 22 are supported by their gripping action with the wallboard and are supported without fasteners. Teeth 23 project from a leg portion 24 of the clips 22 to support an edge-forming strip in a manner to be described more fully below. Clip members 22 are generally U-shaped with legs 24 being in generally opposing relation to legs 25 which lie behind the wallboard 20 in FIG. 2. The gripping action of the clips 22 is provided by the legs 24 and 25.

An elongated finishing strip is designated generally at 26 and is formed of a trim portion 27 and a flange portion 28. Flange portion 28 is insertable between the legs 24 of clips 22 and wallboard 20 to support the trim portion 27 in obscuring relation to the edge 21. The teeth 23 are configured to engage the inner surface of the trim portion 27 to enhance the support of that trim portion 27 by the clip means 23. As illustrated, the lower portion of the leg 24 of the clip 22 may be deflected from the other leg 25 and wallboard 20 to facilitate insertion of the flange 28 between the clip leg 24 and the wallboard 20.

In use, the clips 22 are positioned along the edge to be finished with the wallboard sheet then being positioned as desired. Since the clips 22 require no fasteners, the placement is accomplished with relative ease requiring no alignment with other structures. With the wallboard in position, it may then be secured to the studs or other supporting members. In most instances, the clip 22 will be engaged against a ceiling or other structure to assist in maintaining the clip 22 on the wallboard 20 as the flange 28 is inserted between the leg 24 and the wallboard 20. FIG. 3 illustrates the cooperation between the clip 22 and finishing strip 26.

FIG. 4 illustrates an alternative embodiment having particular suitability for the support of a base molding along the bottom of a partition-forming sheet of wallboard. As in FIGS. 2 and 3, the embodiment of FIG. 4 is a clip formed of two generally parallel legs 30 and 31 with the leg 30 having its terminus deflected away from the leg 31 to facilitate insertion of the finishing strip. The leg 30 is also provided with ears 32 which terminate at the base of the clip at a shoulder-like member 33. One of the ears 32 is shown with teeth 29 which, in some instances, may be employed to facilitate the support of the finishing strip. However, in many applications, the teeth 29 will be unnecessary.

FIG. 5 illustrates the clip of FIG. 4 cooperating with a base molding 35. As illustrated in FIG. 5, a sheet of wallboard 36 has an edge 37 which it is desired to finish. A series of clips of the type illustrated in FIG. 4 are positioned along the edge 37 in spaced relation to each other with the leg 30 lying at the edge. With the clips in position and gripping the wallboard 36, the wallboard may be secured in position as by fastening it to the two-by-four stud illustrated at 38. The finishing strip 35 has a trim portion 39 and a flange portion 40 as well as a shoulder portion 41. With the finishing strip in the desired position obscuring the edge 37, the shoulders 33 and 41 cooperate to enhance the support of the trim portion 39. Again, although illustrated with teeth, the ear portions 32 do not require this construction in many applications.

Referring now to FIGS. 6 and 7, there is illustrated the application of the present invention to the finishing of a door opening. Clips 45 are positioned in spaced relation along the wallboard edge forming the door opening which is to be finished. Clips 45 include two legs which are generally parallel to each other with one leg having its terminus deflected away from the other and from the wallboard to facilitate insertion of the finishing strip. With the clips 45 in place, the wallboard is secured to its supporting structure and finishing strips 46 engage the clips 45. In this instance, the clips 46 are provided with a leg 47 which slip into grooves within the door jam 48. The leg 47 may be provided with barbs for better securement within the grooves of jam 48 to enhance the support of the finishing strips 46.

FIGS. 8 and 9 illustrate an embodiment of the present invention adapted to finish the joint between adjacent sheets of wallboard 50 and 51. A plurality of clips are spaced at an edge of one of the wallboard sheets to be finished in spaced relation to each other. The finishing strip 52 formed of a trim member 53 and a flange portion 54 engage the clips in a manner similar to that described above. However, in this instance the clips 55 are formed of generally opposing legs 56 and 57 with the leg 57 being provided with a detent or dimple 58. A rim 59 is formed at the end of the flange 54 to engage the dimple 58 causing the leg 57 to deflect until the rim 59 has passed the dimple 58 with the dimple 58 then cooperating with the rim 59 to enhance the support of the trim portion 53 over the edges to be finished. Teeth 60 may also be provided on the leg 57 to engage a surface of the trim portion 53 to further enhance its support. The ends of the trim portion 53 may be rolled over as illustrated at 61 to present a visible surface similar to that presented at the junction of the flange 54 and trim portion 53.

Obviously, many modifications and variations of the present invention are possible in light of the above teachings. It is therefore to be understood that, within the scope of the appended claims, the invention may be practiced otherwise than as specifically described.

We claim:

1. Apparatus for supporting an edge-finishing strip along an edge of partition-forming sheets of wallboard which comprises:

a plurality of clip means for engaging said wallboard along its edge in spaced relation to each other, said clip means being supported in close contour snug fitting relationship to said wallboard without fasteners including a plurality of tooth means extending outwardly and away from said wallboard for engaging a portion of a cooperating finishing strip means; and elongated finishing strip means having front facing trim means for obscuring the edge, and including flange means doubled behind itself and extending for a substantial portion along its width and insertable between said clip means and said wallboard for supporting said trim means in obscuring relation to the edge, and having a length generally co-extensive with and in opposing relation to, said trim means, said teeth of said clip means engaging said finishing strip means to guard against disengagement with said clip means.

2. The apparatus of claim 1 wherein said tooth means comprises dimple means, said flange means further comprising rim means cooperating with said dimple means.

3. The apparatus of claim 1 wherein said clip means is formed of two generally parallel legs spaced by a web, the terminus of one of said legs being deflected away from the other of said legs for facilitating insertion of said flange means between said one leg and said wallboard.

* * * * *